US010577177B2

(12) United States Patent
Harvey

(10) Patent No.: US 10,577,177 B2
(45) Date of Patent: Mar. 3, 2020

(54) FLEXIBLE POND LINER

(71) Applicant: Raven Industries, Inc., Sioux Falls, SD (US)

(72) Inventor: Andre A. Harvey, Spring Valley, CA (US)

(73) Assignee: RAVEN INDUSTRIES, INC., Sioux Falls, SD (US)

( * ) Notice: Subject to any disclaimer, the term of this patent is extended or adjusted under 35 U.S.C. 154(b) by 193 days.

(21) Appl. No.: 15/713,228

(22) Filed: Sep. 22, 2017

(65) Prior Publication Data

US 2018/0086553 A1 Mar. 29, 2018

Related U.S. Application Data

(60) Provisional application No. 62/398,701, filed on Sep. 23, 2016.

(51) Int. Cl.

| | |
|---|---|
| ***B65D 90/24*** | (2006.01) |
| ***B65D 90/04*** | (2006.01) |
| ***B65D 88/02*** | (2006.01) |
| ***E04H 7/06*** | (2006.01) |
| ***B65D 90/20*** | (2006.01) |

(52) U.S. Cl.

CPC ..... *B65D 90/24* (2013.01); *B65D 88/02* (2013.01); *B65D 90/046* (2013.01); *B65D 90/205* (2013.01); *E04H 7/06* (2013.01)

(58) Field of Classification Search

CPC ..... B65D 90/00–205; B65D 88/00–02; E04H 7/00–06

USPC ..... 220/4.16

See application file for complete search history.

(56) References Cited

U.S. PATENT DOCUMENTS 1,715,367 A * 6/1929 Jagschitz ..... E04H 7/06 182/82
2,216,701 A * 10/1940 Cole ..... E04H 7/06 29/266
2,313,997 A * 3/1943 Jackson ..... B65D 88/02 220/565
2,355,874 A * 8/1944 Laird ..... B65D 88/34 29/431
2,918,179 A * 12/1959 Dewese ..... B66C 23/163 212/199
3,018,546 A * 1/1962 Dewese ..... E04H 7/06 29/431
3,033,411 A * 5/1962 Brucker ..... E04H 7/06 220/216

(Continued)

*Primary Examiner* — Kareen K Thomas
(74) *Attorney, Agent, or Firm* — Holzer Patel Drennan

(57) ABSTRACT

A pond system includes a single-piece drop-in flexible liner sized and shaped to partially suspend within a rigid sidewall, creating a cavity that may function as a liquid reservoir. The single-piece drop-in flexible liner includes a base portion surrounded by a sidewall portion configured to rest adjacent to an interior-facing surface of the rigid sidewall. The single-piece drop-in flexible liner further includes multiple tensioning tabs each with a fixed end attached to the base portion and a free end opposite the fixed end. Each of the multiple tensioning tabs is configured to extend under the rigid sidewall and radially outward from the base portion. The pond system further includes a means for securing the free end of each of the multiple tensioning tabs at a location external to the perimeter enclosed by the rigid sidewall.

20 Claims, 8 Drawing Sheets

(56) References Cited

U.S. PATENT DOCUMENTS 3,057,054 A * 10/1962 Barnes ..... E04H 7/06
29/429
3,096,901 A * 7/1963 Arne ..... B65D 88/02
220/565
3,105,617 A * 10/1963 Felldin ..... B65D 77/061
222/181.3
3,325,177 A * 6/1967 Welinder ..... B60P 3/2205
280/837
3,412,891 A * 11/1968 Klimpl ..... B29C 70/10
220/645
3,468,451 A * 9/1969 Coleman ..... B65D 25/14
220/495.11
3,502,240 A * 3/1970 Paton ..... B65D 88/62
220/530
4,608,175 A * 8/1986 Nuttle ..... C02F 1/14
210/532.2

* cited by examiner

FLEXIBLE POND LINER

CROSS-REFERENCE TO RELATED APPLICATIONS

The present application claims the benefit of priority to provisional patent application 62/398,701, entitled "Single Piece Pond Liner" and filed on Sep. 23, 2016, which is specifically incorporated by reference for all that it discloses or teaches.

BACKGROUND

Above ground containment structures, such as those commonly used for storage (e.g., petroleum, waste, water), aquaculture, algae growth, farming, etc., may include a flexible liner that prevents liquid from seeping into the ground below. However, flexible liners are vulnerable to displacement and damage from the elements, such as wind and air pressure. For example, strong winds may be capable of ripping a liner away from one or more points of attachment to a sidewall. At times when no liquid is stored in the containment structure, differences in air pressure above and below the liner can cause the liner to puff upward (e.g., like a mushroom or muffin top). Displacement of the liner can weaken the integrity of and/or tear the liner.

SUMMARY

Implementations described herein address the foregoing by providing a single piece drop-in pond liner with a number of features that mitigate liner displacement and damage. According to one implementation, the flexible liner includes a base portion, a sidewall portion, and multiple tensioning tabs. The base portion and the sidewall portion form a cavity when the sidewall portion is secured against a rigid supporting sidewall, and the tensioning tabs each include a fixed end attached to the base portion and a free end opposite the fixed end that is configured to extend under the rigid supporting sidewall and radially outward from the base portion.

This Summary is provided to introduce an election of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

BRIEF DESCRIPTIONS OF THE DRAWINGS

DETAILED DESCRIPTION

Figure 1:
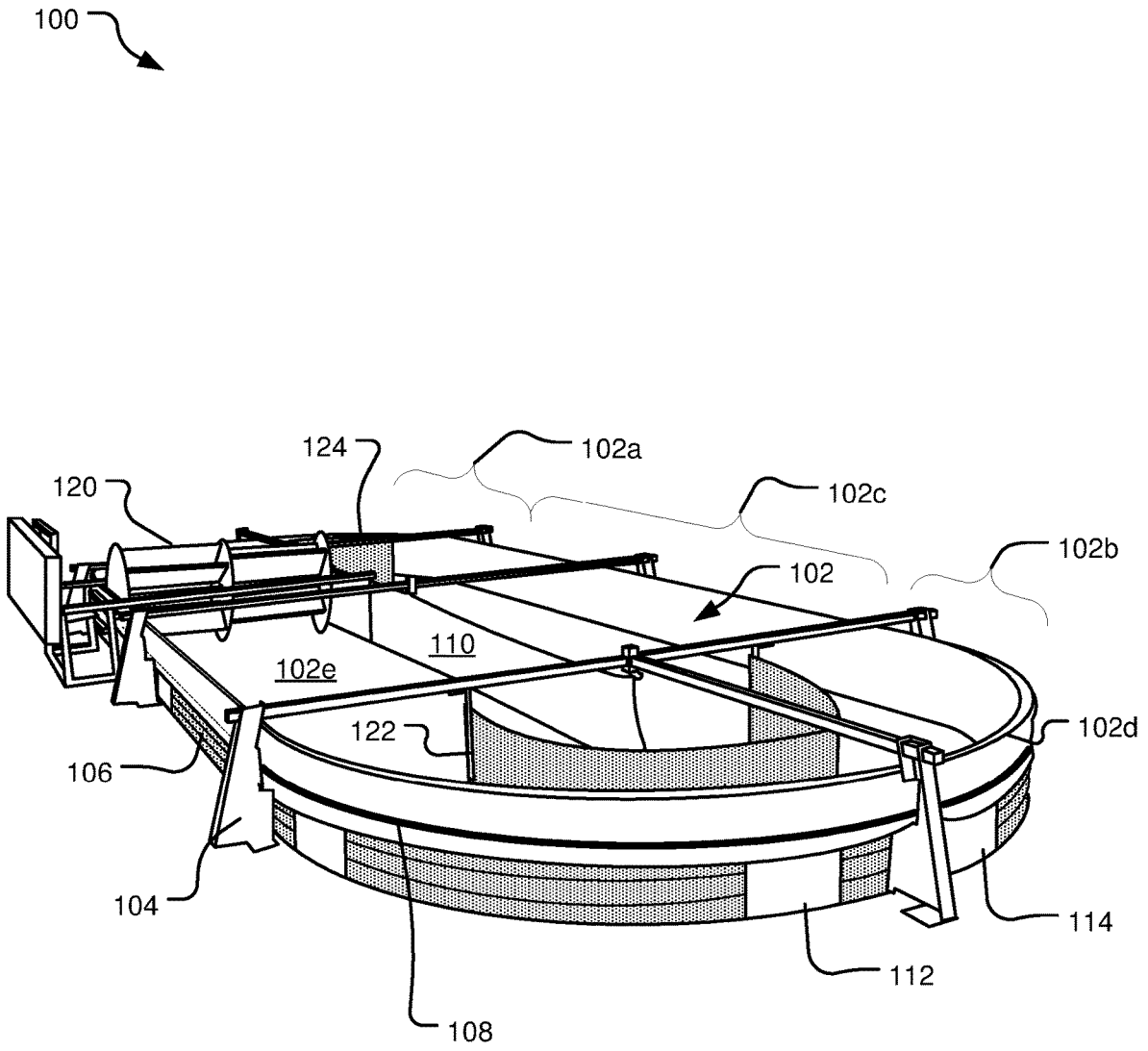
FIG. 1 illustrates an example pond system with a flexible liner.

FIG. 1 illustrates an example pond system 100 with a flexible liner 102 having a number of features designed to promote long-term durability, reduce the build-up of contaminates, and simplify maintenance and assembly. In different implementations, the flexible liner 102 may be used in conjunction with different types of pond and storage systems, including both in-ground and above-ground reservoirs. In FIG. 1, the pond system 100 includes a rigid sidewall 106 (e.g., a metal, corrugated wall) enclosing an internal area. The rigid sidewall 106 is shown to be generally cylindrical in shape but may, in other implementations, assume other shapes and sizes such as rectangular, circular, etc. In one implementation, the rigid sidewall 106 is a free-standing enclosed structure that does not include a base connecting the opposite sides of the rigid sidewall 106 together.

In one implementation, the flexible liner 102 is a single-piece liner made of a flexible, liquid-impermeable material. The flexible liner 102 has a base portion 102*e* that rests internal to the rigid sidewall 106 (e.g., against the ground or subgrade), while a lipped perimeter portion 102*d* of the flexible liner 102 wraps up and over a top edge of the rigid sidewall 106 so that a perimeter of the flexible liner 102 rests adjacent to the external surface of the rigid sidewall 106.

Although a variety of shapes are contemplated for use in different implementations, the flexible liner 102 is, in one implementation, pre-formed with two rounded ends 102*a*, 102*b* separated by an elongated midsection 102*c*. In one implementation, the lipped perimeter portion 102*d* is formed by folding a perimeter portion of the flexible liner 102 up and over the upper perimeter of the rigid sidewall 106 and securing a perimeter of the flexible liner 102 in place against the external surface of the rigid sidewall 106. In other implementations, the lipped perimeter portion 102*d* is formed (e.g., sewn) to have a predefined curvature for resting against the top edge of the rigid sidewall 106.

The flexible liner 102 further includes a plurality of tensioning tabs (e.g., tabs 112, 114) that extend under the rigid sidewall and outwardly away from the base portion 102*e*. In FIG. 1, the tensioning tabs 112, 114 are each tensioned upward and secured against the exterior-facing surface of the rigid sidewall 106. For example, each of the tensioning tabs 112, 114 is tensioned at a point underlying the lipped perimeter portion 102*d*, which is wrapped over a top edge of the rigid sidewall 106 and folded down to hide the top edge of each of the tensioning tabs 112, 114.

Although the lipped perimeter portion 102*d* may be secured in a variety of ways in different implementations, the lipped perimeter portion 102*d* of FIG. 1 is secured against the exterior-facing surface of the rigid sidewall 106 by a cable 108 that is threaded around the lipped perimeter portion 102*d* and through various securement mechanisms (e.g., set screws, clamps, etc.) proximal to each of a number of buttresses (e.g., a buttress 104) supporting the rigid sidewall 106. For example, the cable 108 wraps around the rounded portion 102*b* of the flexible liner 102 and threads through a hemmed loop (not shown) formed in an edge of the elongated midsection 102*c* to tension the flexible liner 102 against the sidewall 106 (e.g., as shown in greater detail by cables 842 and 844 of FIG. 8).

Although the flexible liner 102 may be secured to the rigid sidewall 106 in different ways, the illustrated configuration is advantageous because points of tension (e.g., below the cable 108) are entirely external to the reservoir formed by the rigid sidewall 106. In general, pond system fixtures contacting the interior or top rim of the sidewall may create several difficult-to-clean contact areas and small openings (e.g., crevasses, interface cracks, wedges) where bacteria are prone to develop and flourish if not cleaned regularly and diligently. For example, some systems may secure a liner using components such as clamps and levers that contact the liner at locations internal to the reservoir. These component interfaces may include wedges or cracks where contaminates build-up over time. The illustrated method of securing the flexible liner 102 by applying a tension along the exterior-facing surface of the rigid sidewall 106 is advantageous because it decreases a number of components that must be regularly cleaned to prevent growth of unwanted bacteria (e.g., in interface cracks, wedges, etc.).

In different implementations, the tensioning tabs 112, 114 may be separated from one another at even or uneven intervals about the perimeter of the rigid sidewall 106. Each tensioning tab 112, 114 attaches to an underside (not shown) of a base 102*e* of the flexible liner 102 and is positioned relative to the rigid sidewall 106 such that the tensioning tabs 112, 114 may extend radially outward beneath the rigid sidewall 106. The tensioning tabs 112, 114 generally serve to tension a perimeter of the base 102*e* of the flexible liner 102 radially outward from a center of the flexible liner 102 and to keep the base 102*e* flat. In some existing systems that do not include these tabs or other mechanisms for tensioning the pond liner at the base 102*e*, air pressure differences and/or wind can cause the pond liner to "uplift" in the middle and even rise up above the rigid sidewall 106 (e.g., forming a muffin-top effect) when there is little or no liquid stored in the pond. This uplift effect makes the flexible liner 102 vulnerable to tears and punctures. Moreover, the tensioning tabs 112, 114 also help to prevent the flexible liner 102 from being drawn-up into a paddle wheel 120 or aerator (not shown) that may be included in implementations where the pond system 100 supports an algae or aquaculture application. Further still, the tensioning tab design may help to prevent the flexible liner 102 from prolapsing out between gaps residing between the rigid sidewall 106 and a subgrade (not shown) due to head pressure imparted by the stored water/liquid media.

Attachment of the tensioning tabs 112, 114 to underside (not shown) of the base 102*e* of the flexible liner 102 may be accomplished in a variety of suitable ways including, without limitation, stitching, adhesives, magnets, etc.

Tensioning of each tab 112, 114 may also be accomplished in a variety of different ways. In one implementation, a free end of each tensioning tab 112, 114 includes a hemmed loop or other aperture suitable for receiving a cable, rope or other elongated securement mechanism. For example, the tensioning tabs 112, 114 are each lashed against an exterior-facing surface of the sidewall 106 (as shown) via a wire or rope that threads through an aperture (e.g., hemmed loop) in each of the tensioning tabs 112, 114.

In some implementations, the tensioning tabs 112, 114 do not secure up against the exterior-facing surface of the sidewall 106 as shown. Instead, the tensioning tabs 112, 114 are affixed away from the rigid sidewall 106 and secured to the ground (e.g., staked into place or buried within an anchor trench).

In at least one implementation, the pond system 100 includes one or more elongated (e.g., continuous) tensioning tabs in lieu of the multiple separated tensioning tabs 112, 114 illustrated in FIG. 1. For example, a single tensioning tab may extend continuously along the elongated midsection 102*c* of the flexible liner 102. In this case, one or more shorter, individuated tensioning tabs may be included along the curved portions 102*a*, 102*b* of the flexible liner 102. In still another implementation, a single continuous tensioning tab extends about a full perimeter of the rigid sidewall 106.

In addition to helping to stabilize the flexible liner 102 within the pond system 100, the tensioning tabs 112, 114 may also help to counter shrinkage tendencies of the flexible liner 102 that can occur as the liner ages and/or is exposed to sunlight. Liner shrinkage in ponds can result in deformation of the original desirable fitment. Shrinkage can cause liners to pull away from walls, especially in vertically-walled ponds at edges of intersection between the floor and wall(s). This weakens liners and can cause separation between different liner layers (e.g., separation from a backing or support structure), leaving the liners vulnerable to rupture from the weight of the fluid supported in the pond system. Tensioning tabs can help to counter this shrinkage tendency and maintain liners against the contours of their supporting pond structures.

Another peril of liner shrinkage occurs within pond systems having paddle wheels, such as algae raceway ponds. In these pond systems, liners can be drawn into contact with the paddle wheel during shrinkage, causing damage to the liner. Having a tensioning tab or tabs adjacent to paddle wheel locations can prevent shrinkage-induced contact and also help to counteract the suction induced on liners by the action of paddle wheel rotation that lifts water between them and the liner below.

In addition to the features described above, the flexible liner 102 further includes a baffle curtain 110 attached to and extending longitudinally across the base 102*e* of the liner 102. The baffle curtain 110 aids a paddle wheel 120 and one or more cylindrical guides (e.g., identical cylindrical guides 122, 124) in circulating a liquid volume stored in the reservoir of the pond system 100 around the baffle curtain 110. Although some implementations may include a baffle curtain 110 that is separate from the flexible liner 102, installation may be simplified considerably when the baffle curtain 110 is formed as part of the flexible liner 102, as shown and described herein. In addition, the disclosed configuration is advantageous because liquid and contaminates are prevented from migrating under the baffle curtain 110 when the baffle curtain 110 is formed as part of the drop-in liner. This further simplifies cleaning and maintenance of the pond system 100.

In one implementation, the base 102*e* of the liner 102 further includes a sleeve or a pocket (not shown) for receiving and securing some supportive structural components of the paddle wheel 120. An example liner pocket is shown in greater detail with respect to FIG. 3. For example, a liner pocket may be formed on the underside of the base 102*e* and sized and positioned such that a structural component of a paddle wheel 120 may be inserted under the rigid sidewall 106 and within the pocket. This design prevents contact between structural paddle wheel components and the base 102*e* of the liner 102, thereby preventing water migration into areas (e.g., liner/paddle wheel interfaces) prone to bacterial growth in traditional systems.

Figure 2:
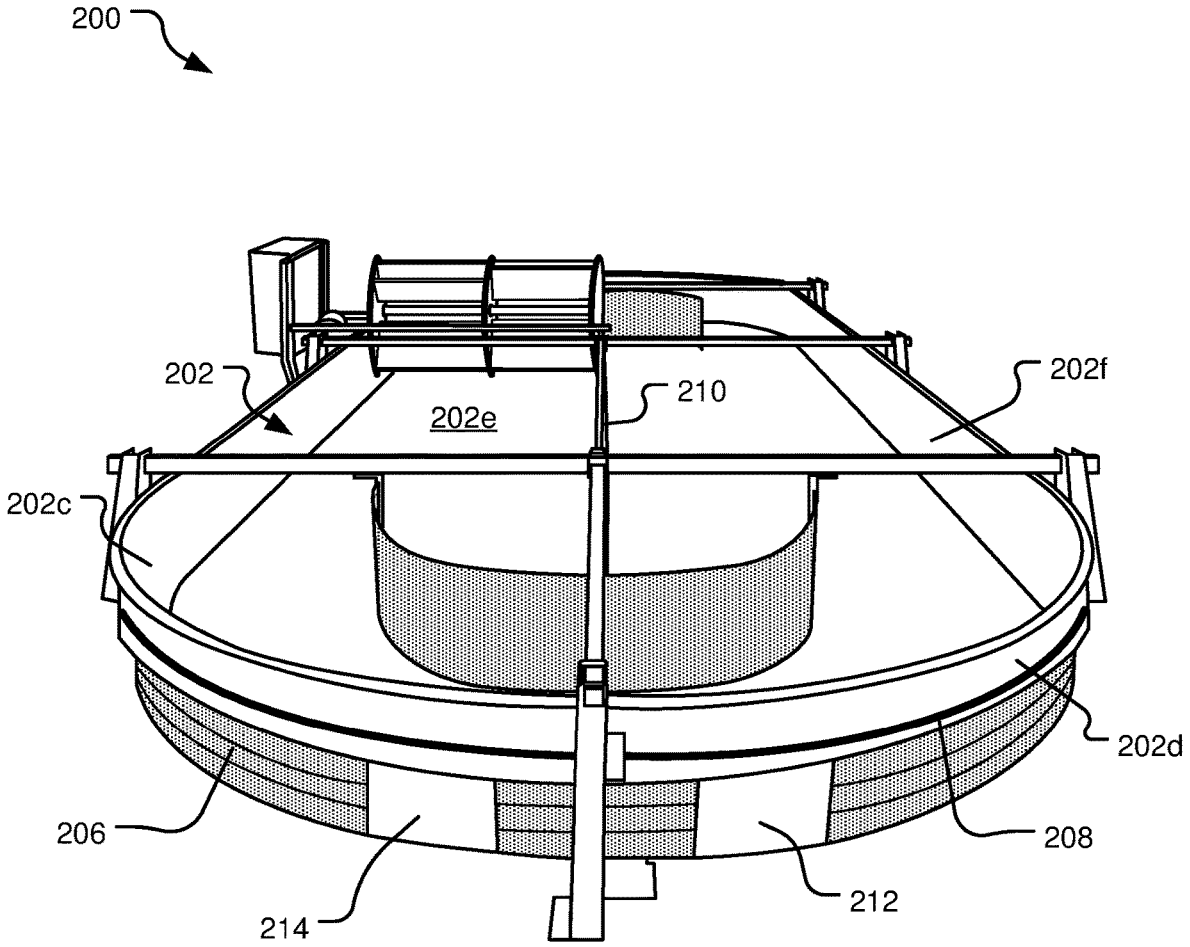
FIG. 2 illustrates an end-on view of a portion of an example pond system including a single piece flexible liner

FIG. 2 illustrates an end-on view of a portion of another example pond system 200 including a flexible liner 202. The flexible liner 202 is a single-piece liner including a base portion 202*e* and sidewall portions (e.g., 202*c*, 202*f*). The base portion 202*e* forms a base of a reservoir that rests adjacent to the ground or underlying subgrade while the sidewall portions 202*c*, 202*f* form walls of the reservoir that rest adjacent to an interior-facing surface of a rigid sidewall 206. The sidewall portions 202*c*, 202*f* further include a lipped perimeter portion 202*d* that is fitted to wrap over a top edge of the sidewall 206. A cable 208 secures a perimeter of the lipped portion 202*d* against an exterior-facing surface of the sidewall 206. In one implementation, the cable 208 also threads through hemmed portions of the sidewall 202*c*, 202*f*, such as hems along an elongated perimeter of the sidewall portions 202*c*, 202*f* (e.g., hems 830 and 832 shown in FIG. 8).

The flexible liner 202 further includes a number of tensioning tabs (e.g., a tensioning tabs 212, 214) extending from a downward-facing surface (not shown) of the base 202*e* of the flexible liner 202. Each of the tensioning tabs 212, 214 extend under the rigid sidewall 206 and is tensioned up against the exterior-facing surface of the rigid sidewall 206, as shown. In one implementation, a free end of each of the tensioning tabs 112, 114 includes a hemmed loop (not shown) that is sized and shaped to receive a cable, rope, strap or band, which may be different than the cable 208. For example, a cable or rope may be positioned under the perimeter of the lipped portion 202*d*, wrapped about the rigid sidewall 206, and threaded through each of a number of the different tensioning tabs 112, 114.

The flexible liner 202 further includes a baffle curtain 210 that extends longitudinally across the base 202*e* of the flexible liner 202. The baffle curtain 210 is formed directly in the base 202*e* such that an interface between the base 202*e* and the baffle curtain 210 is liquid-impermeable.

Figure 3:
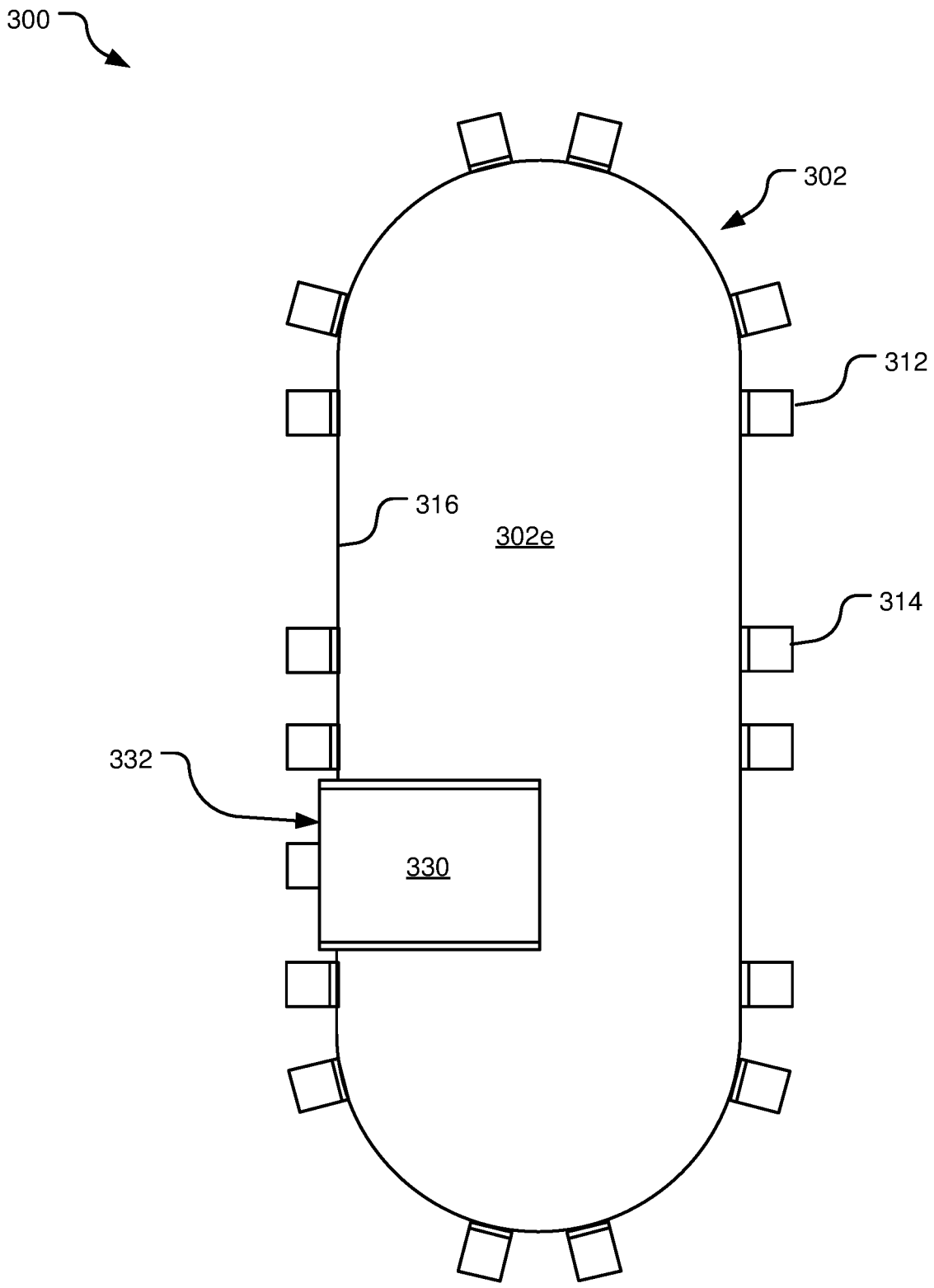
FIG. 3 illustrates a schematic of an under-side view of an example single piece flexible liner for a pond system.

FIG. 3 illustrates a schematic 300 of an under-side view (e.g., a ground-facing surface) of an example flexible liner 302 for a pond system. The flexible liner 302 is a single-piece liner including a number of tensioning tabs (e.g., tensioning tabs 312, 314) that extend radially outward from a central base portion 302*e* of the flexible liner 302. In the illustrated schematic 300, the flexible liner 302 is pictured from below, as if partially secured to form a reservoir within an enclosed sidewall. For example, the schematic 300 illustrates the ground-facing surface of the flexible liner 302 after the base portion 302*e* has been positioned to partially-suspend within an enclosed sidewall (not shown) but before the tensioning tabs (e.g., the tabs 312, 314) have been tensioned in place. The tensioning tabs are shown extending radially away from the base 302*e*, and the base has a perimeter 316 that may generally align with or rest adjacent to a bottom perimeter edge of the enclosed sidewall (not shown).

Traditionally, without securing a flexible liner in some fashion, such as ballasting or battening against structures, paddle wheel action can result in hydraulic forces and momentum that can draw a liner up into the wheel itself causing system damage or causing horizontal displacement that stresses the flexible liner 302. For example, the flexible lining material may be stretched by hydraulic forces and laterally contorted and wrinkled in the direction of flow. In aquaculture and algae ponds, contorted and/or wrinkled liners can create harbors for undesirable bacteria that become established in such areas that can cause great harm or even total destruction of the commercial stock contained within a pond. These harbors for bacteria are reduced or eliminated by the present design, which utilizes the tensioning tabs (e.g., tabs 312, 314) to keep the base 302*e* of the flexible liner 302 taught.

In addition to those features described above, the flexible liner 302 includes a pocket 330 (or in some implementations, a sleeve with two open ends) with an opening 332 accessible on a ground-facing surface of the central base portion 302*e*. In FIG. 3, the opening 332 is shown adjacent to the perimeter 316 of the central base portion 302*e* and facing away from a center of the flexible liner 302. In other implementations, the opening 332 may be placed differently. An item (such as a rigid supportive element, not shown) can be inserted into the opening 332 of the pocket 330 from the exterior of the pond system. For example, a supportive element may be inserted under a sidewall of the pond (e.g., under element 106 in FIG. 1) and into the pocket 330 without ever being placed within the cavity formed by the flexible liner 302.

Figure 4:
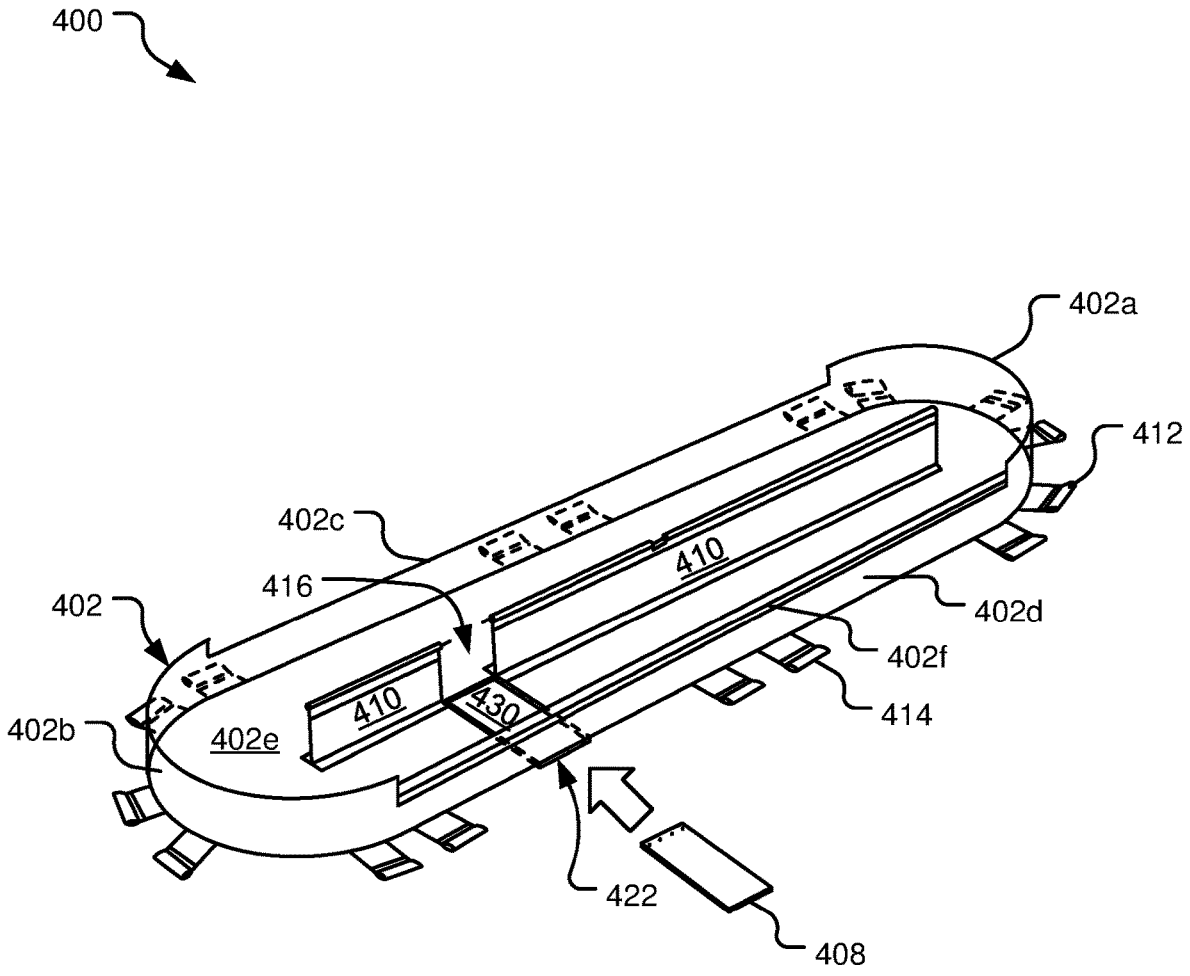
FIG. 4 illustrates a perspective view of a flexible liner shown in a position assumed when the flexible liner is suspended within and partially secured against a rigid enclosed sidewall.

In one implementation, the flexible liner 302 is used in a pond system, including a paddle wheel (not shown), and the pocket 330 receives a planar base portion of the paddle wheel that connects to a structural footing component of the paddle wheel, as in 408 of FIG. 4. Securing or confining a base of the paddle wheel within the pocket 330 reduces the number of interfaces (e.g., edges and cracks between adjacent surfaces) within a reservoir of the pond system where unwanted bacteria may grow, ultimately reducing system maintenance. Another advantage of this arrangement is that insertion of a paddle wheel base into the sleeve/pocket may prevent multi-planar movement of the flexible liner 302 that could otherwise be induced by the tractive forces of water dragging over the flexible liner's surface as induced by the rotation of the paddle wheel just above the sleeve/pocket location.

As mentioned above, the pocket 330 provides a mechanism for attaching the paddle wheel to the flexible liner 302 without contact with an interior surface of flexible liner 302 that is designed to be in contact with liquid stored within the reservoir of the pond system. This simplifies assembly, allowing for paddle wheel integration without construction of an independent support structure for the paddle wheel (e.g., such as a supporting structure with vertical beams extending into the subgrade). Consequently, the pond system 300 may be assembled on-site without constructing any permanent structures affixed to the ground until certain size limits may be reached whereby addition support or augmentation becomes necessary on wider ponds.

FIG. 4 illustrates a perspective view of a flexible liner 402 shown in a three-dimensional position assumed when the flexible liner 402 is arranged within a pond system and supported by various supporting structures (not shown). The flexible liner 402 includes rounded edge portions 402*a* and 402*b* and straight edge portions 402*c* and 402*d* shown in an upright position (as if secured against a rigid enclosed sidewall, such as when secured against the rigid sidewall 106 as shown in FIG. 1).

The flexible liner 402 includes a number of tensioning tabs (e.g., tensioning tabs 412, 414) that extend radially outward from a perimeter of a base portion 402*e* of the flexible liner 402. The tensioning tabs 412, 414 are flexible segments designed to extend underneath a sidewall (not shown) to positions external to a reservoir bounded by the sidewall. The tensioning tabs 412, 414 can be secured to a surface or structure external to the reservoir to tension the base portion 402*e* of the flexible liner 402 radially outward.

In one implementation, the tensioning tabs 412, 414 are designed for securement to the ground, such as by inserting stakes through apertures formed in each one of the tensioning tabs. In other implementations, the tensioning tabs are designed to be folded upward and tensioned against an external surface of a reservoir sidewall, such as in the manner shown and described with respect to FIGS. 1 and 2.

The straight edge portions 402*c* and 402*d* of the liner include a lipped upper portion (e.g., lipped upper portion 402*f* visible in FIG. 4 along the straight edge portion 402*d*) that is shown folded back on itself. The rounded edge portions 402*a* and 402*b* may be similarly configured to fold, but are shown in an upright, unfolded position.

In addition to the features described above, the flexible liner 402 further includes a baffle curtain 410 attached to and extending along a longitudinal axis of the flexible liner 402. In different implementations, the baffle curtain 410 may be continuous or discontinuous. In FIG. 4, the baffle curtain 410 is discontinuous and includes a cut-out portion 416 where structural components of a drop-in paddle wheel (not shown) can be inserted on-site when the pond system is assembled. The baffle curtain 410 acts as a divider around which current may flow due to rotation of the paddle wheel. Although some implementations may include a baffle curtain 410 that is separate from the flexible liner 402, installation of the liner and pond system is simplified considerably when the baffle curtain 410 is formed as part of the flexible liner 402, as shown. In general, the baffle curtain 410 is formed such that liquid may not permeate the interface (e.g., seam or fold) between the baffle curtain 410 and the base portion 402*e* of the flexible liner 402.

The flexible liner 402 further includes a pocket 430 (or in some implementations, a sleeve with two open ends) with an opening 422 accessible to a location external to the reservoir formed by the flexible liner 402 and rigid sidewall (not shown). In FIG. 4, the opening 422 is flush with a perimeter edge of the base portion 402*e*. An item (such as a rigid supportive element) can be inserted into the opening 422 of the pocket 430 from the exterior of the pond system. For example, a supportive element (e.g., a paddle wheel frame component 408) may be inserted under a sidewall of the pond (e.g., under element 106 in FIG. 1) and into the pocket 430 without ever being inserted into the reservoir formed by the flexible liner 402.

Figure 5:
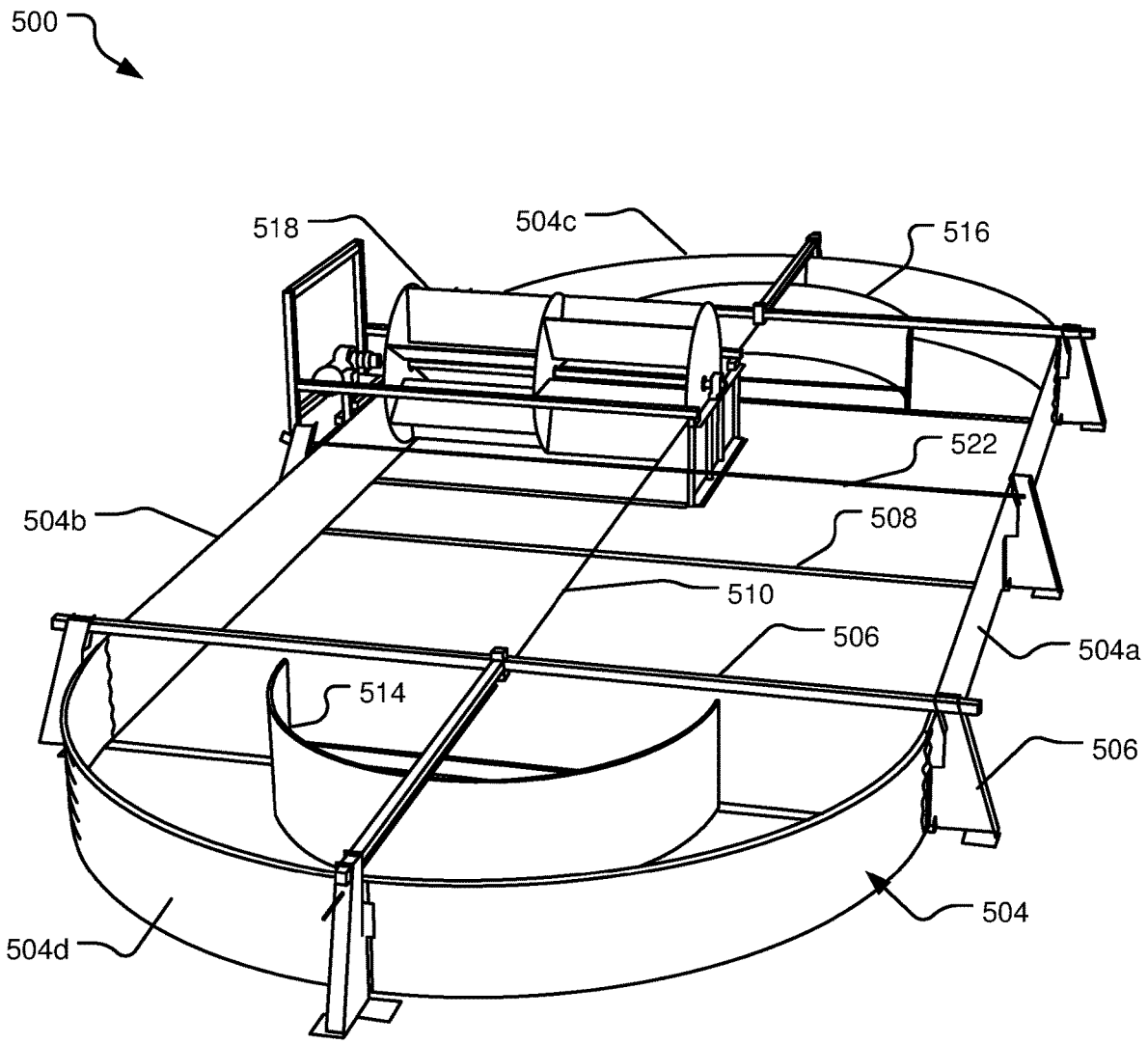
FIG. 5 illustrates a perspective view of an example pond system including supportive sidewall and a number of components that position and secure a pond liner.

FIG. 5 illustrates a perspective view of an example pond system 500 including a rigid sidewall 504 and a number of components suitable for supporting and securing a flexible liner (not shown), such as the flexible liners disclosed with respect to FIGS. 1-4. The pond system 500 includes a rigid sidewall 504 enclosing an internal space. Although sidewalls of a variety of shapes may be suitable for use in conjunction with the disclosed technology, the rigid sidewall 504 is formed by two substantially straight rigid components 504*a*, 504*b* and two generally elliptical or round components 504*c*, 504*d*. The rigid sidewall 504 is shown to be corrugated but may also be generally planar. A number of buttresses (e.g., a buttress 510) are distributed about the perimeter of the rigid sidewall 504. These buttresses 510 serve a number of functions, such as supporting cross ropes and crossbeams (e.g., a header crossbeam 506, cross rope 522, and a footer cross strap 508). The attachment points between the crossbeams and corresponding buttresses supply an inward force the buttresses 510, counteracting an outward force against the rigid sidewall 504 supplied by a volume of liquid stored therein (not shown). In addition, cross beams and ropes can also stabilize an internal wall, vane or baffle detail.

In one implementation, the buttresses 510 each attach to and tension a portion of the flexible liner that is folded up and over the rigid sidewall 504. For example, the pond liner may be secured by each buttress (e.g., a buttress 510) at a location external to the rigid sidewall 504 in order to locally tension the flexible liner.

A paddle wheel 518 provides a current flow within a reservoir of the pond system 500 and turning vanes 514, 516 acts as guides that help to circulate a liquid volume stored in the pond system 500 around a baffle curtain (not shown).

Figure 6:
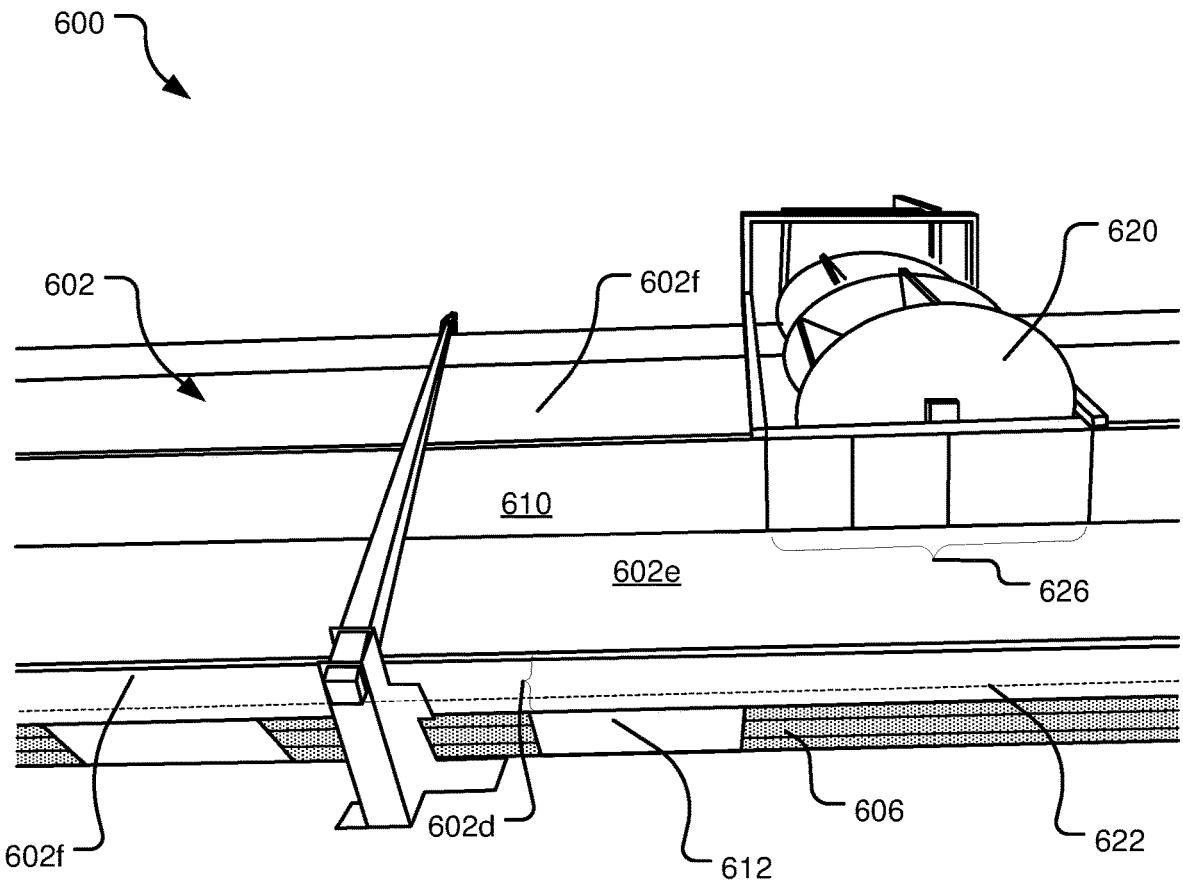
FIG. 6 illustrates a side perspective view of another example pond system with a flexible liner.

FIG. 6 illustrates a side perspective view of another example pond system 600 including a reservoir formed by a flexible liner 602 partially-suspended within and secured relative to a rigid sidewall 606. The flexible liner 602 is a single-piece drop-in liner that includes a base portion 602*e*, sidewall portions (e.g., a sidewall portion 602*f*), and a lipped portion 602*d*. The sidewall portions 602*f* rest adjacent to an interior-facing surface of a rigid sidewall 606 while the lipped portion 602*d* wraps over a top edge of the rigid sidewall 606. In one implementation, a cable (not shown) is threaded through a hemmed loop 622 formed along an outer perimeter of the lipped portion 602*d* and tensioned against the rigid sidewall 606. Positioning of example cables relative to the hemmed loop 622 and curved end portions (not shown) of the single piece flexible liner 602 are shown in greater detail with respect to FIG. 8.

The flexible liner 602 further includes a number of tensioning tabs (e.g., a tensioning tab 612) that extend from the base 602*e* of the flexible liner 602, under the rigid sidewall 606, and wrap-up and against the exterior-facing surface of the rigid sidewall 606. In one implementation, a free end of each of the tensioning tabs 612 includes a hemmed loop 622 or other aperture for receiving a cable or rope, which may be used to secure the tensioning tabs 612 to the rigid sidewall 606, such as at locations beneath the lipped portion 602*d* of the flexible liner 602. In another implementation, the tensioning tabs 612 can be made to attach to the lipped portion 602*d* of the flexible liner 602 via fasteners through grommets in both elements or by other methods.

The flexible liner 602 further includes a baffle curtain 610 that extends longitudinally across the base 602*e* of the flexible liner 602. In FIG. 6, the baffle curtain 610 is discontinuous and includes a cut-out portion 626 where structural components of a drop-in paddle wheel 620 are inserted.

Figure 7:
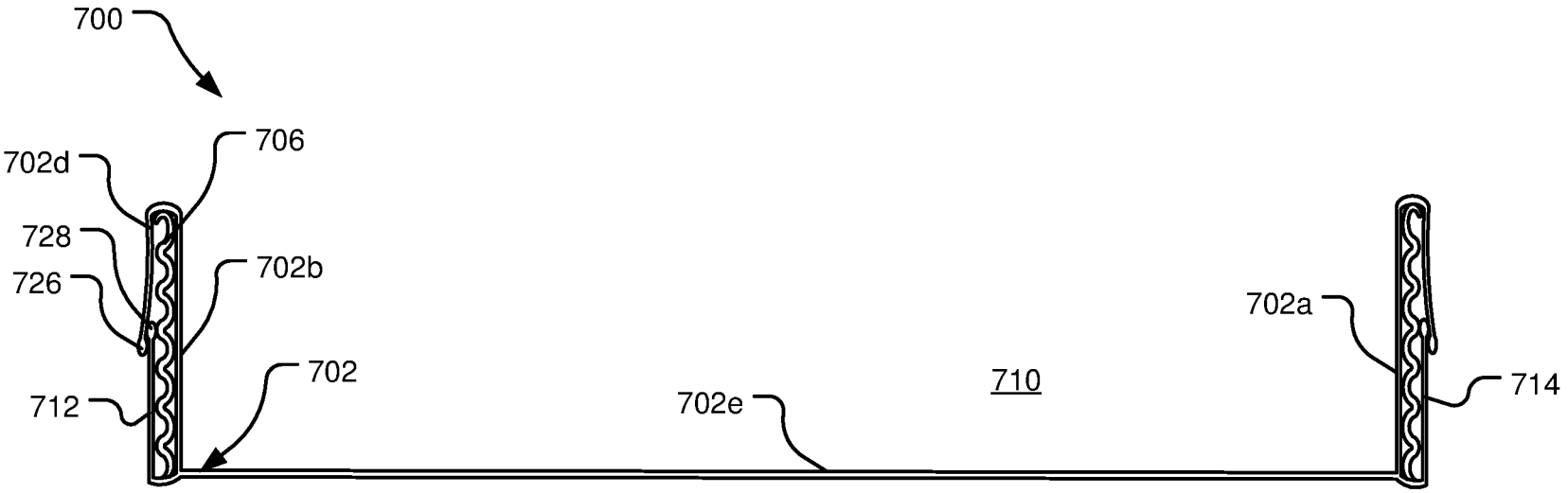
FIG. 7 illustrates a cross-sectional view of an example pond system including a number of components that position and secure a pond liner.

FIG. 7 illustrates a cross-sectional view of a pond system 700 including a number of components that position and secure a flexible liner 702 relative to a rigid sidewall 706. In FIG. 7, the rigid sidewall 706 is a corrugated cylindrical wall. The flexible liner 702 is draped over the rigid sidewall 706 and suspended within an area 710 enclosed by the rigid sidewall 706, thereby forming a cavity bounded by a base portion 702*e* and side portions 702*a*, 702*b* of the flexible liner 702.

The flexible liner 702 includes a lipped upper portion 702*d* that is folded over a top of the rigid sidewall 706 and tensioned downward (toward the ground) and/or inward (against the rigid sidewall 706), such as by a cable or wire that is threaded through a hemmed loop 726 formed in a perimeter edge of the flexible liner 702 and tensioned against the rigid sidewall 706.

In one implementation, the hemmed loop 726 extends about a perimeter off all or a portion of the pond system 700 and a wire or rope is threaded through the hemmed loop 726 to provide a downward tension on the edge of the flexible liner 702. If the wire or rope threaded through the hemmed loop 726 is made to encircle all or a substantial portion of the perimeter of the rigid sidewall 706, the wire or rope also effectively acts to secure the pond liner 702 against the exterior-facing surface of the rigid sidewall 706. In lieu of a wire or rope, some implementations may use a band, cable, strap, etc. In still other implementations, the pond system includes supporting buttresses (not shown) that include securement mechanisms such as set screws, clamps, etc. that are designed to pinch the flexible liner 702 against the exterior-facing surface of the rigid sidewall 706.

The flexible liner 702 also includes a plurality of tensioning tabs (e.g., tensioning tabs 712, 714) that extend from the base portion 702*e* of the flexible liner 702 and outward underneath the rigid sidewall 706. Each of the tensioning tabs (e.g., tabs 712, 714) is tensioned upward (e.g., away from the ground) and/or inward (against the rigid sidewall 706). In one implementation, each of the tensioning tabs includes an aperture (e.g., a hem 728) and a cable or wire is threaded through the aperture in each one of the tabs and tensioned against the exterior-facing surface of the sidewall 706. Although a variety of shapes are contemplated, the tensioning tabs are, in one implementation, rectangular pieces of material.

Figure 8:
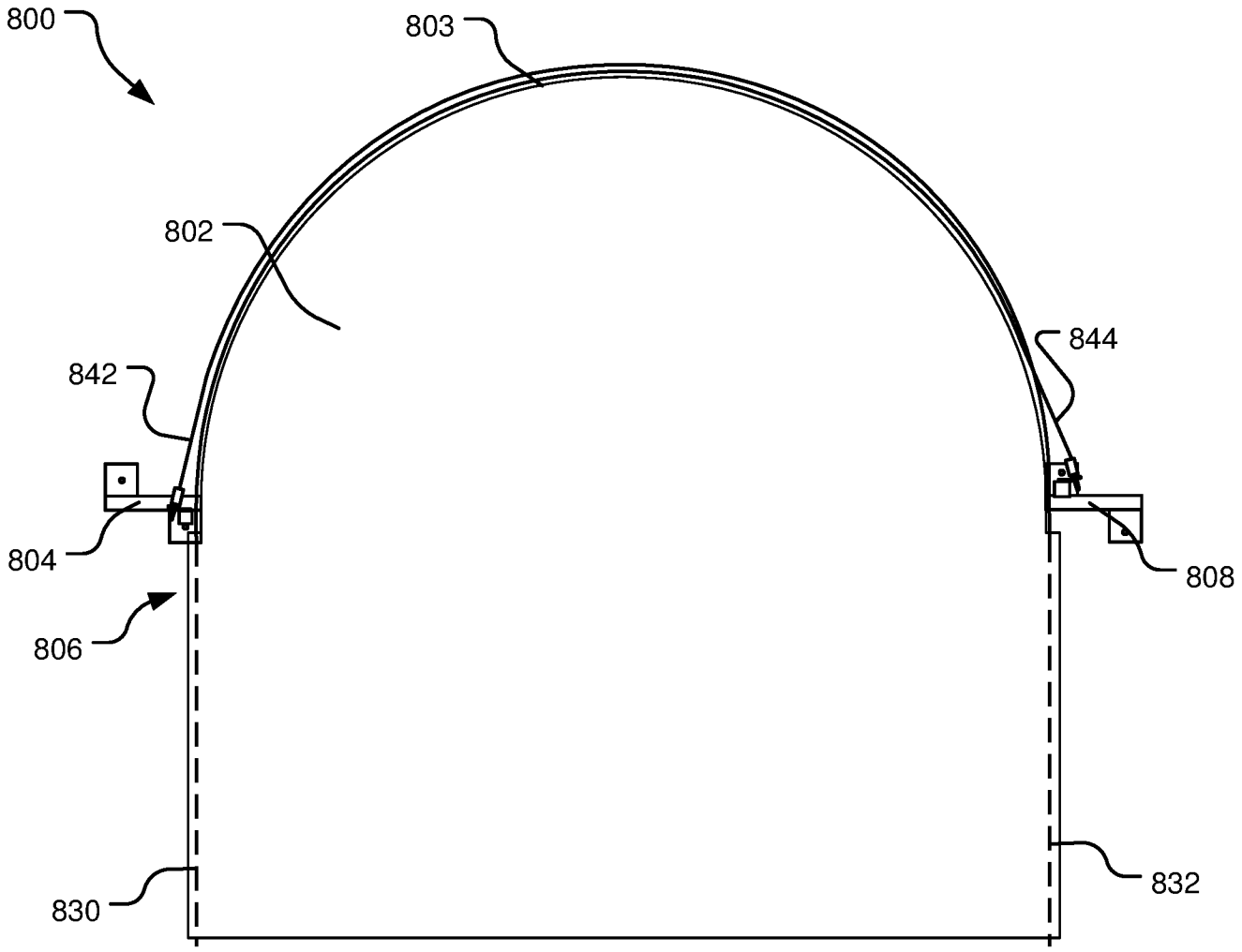
FIG. 8 illustrates a top-down view of another example pond system including a single piece flexible liner.

FIG. 8 illustrates a top-down view of another example pond system 800 including a flexible liner 802. The pond system 800 includes a rigid sidewall 806 supported by a number of buttresses (e.g., buttresses 804, 808) spaced out about the perimeter of the rigid sidewall 806. The flexible liner 802 is a single-piece liner that is partially suspended within a cavity enclosed by the rigid sidewall 806. When suspended, the flexible liner 802 forms a base and sidewalls of the cavity. Although other configurations are contemplated, the flexible liner 802 of FIG. 8 includes two hemmed portions 830, 832 positioned along an outer edge of the rigid sidewall 806 and adjacent to an elongated midsection of the flexible liner 802 (see, e.g., hemmed portions indicated by dotted lines). Additional portions of the flexible liner 802 may wrap around a top edge of the rigid sidewall 806 and rest adjacent to curved end portions of the rigid sidewall 806, such as adjacent to a curved end portion 803.

The flexible liner 802 is secured against the rigid sidewall 806 by cables 842, 844 (which may also be ropes, chains, etc.). Although the cables 842, 844 may be secured in a number of suitable ways, the cables 842 and 844 are—in FIG. 8—each secured to a buttress 804 or 808 and positioned to wrap around the curved end portion 803 of the rigid sidewall 806 and thereby tension a portion of the flexible liner 802 against an exterior surface of the curved end portion 803. Specifically, the cable 842 has a first end secured to the buttress 804 and a middle portion that wraps around the curved end portion 803 of the rigid sidewall 806 before extending through the hemmed portion 832 of the flexible liner 802 to an end opposite the first end that is secured to another buttress (not shown). The cable 844, in contrast, has a first end secured to the buttress 808 and a middle portion that wraps around the curved end portion 803 of the rigid sidewall 806 before extending through the hemmed portion 830 of the flexible liner 802 to an end opposite the first end that is secured to another buttress (not shown).

In one implementation, the hemmed portions 830 and 832 are long straight side hems that help support the load of the cables 842 and 844 against movement and also help secure the flexible liner 802 from pulling away from it. In that regard, loops and or hems can be substituted and may also be incorporated on radial ends in some implementations.

The hemmed portions 830, 832 of the flexible liner 802 may have occasional breaks (e.g., apertures) allowing the cables 842, 844 to thread out of the respective liner hems and through a slot or hole in each of a number of buttresses spaced about the perimeter of the rigid sidewall 806. For example, the cable 842 may emerge from the hemmed portion 832 immediately adjacent to a buttress, thread through a slotted hole of a buttress, and thread back into the hemmed portion 832 on an opposite side of the buttress. In this manner, the cables 842, 844 may each be tensioned and secured by one or more of the buttresses 804, 808 around the perimeter of the pond system 800.

It should be appreciated that uniform hoop-style tension provided by the illustrated pond system 800 can, in some cases, eliminate the need for vertical plane support.

In some implementations, a perimeter cable or band or strap system may or may not be concealed within a perimeter hem (e.g., as shown in FIG. 8). In another implementation, the lengths of cables or perimeter banding materials that extend beyond a hem (e.g., around curved portions of the pond system) can be sheathed within slippery material tubes or rest over slip sheets that allow the cables or bands to be tightened around the curved ends of the pond system with minimal frictional resistance that might otherwise be present, such as when cabling or banding bears directly against a liner such as a EPDM or CSPE rubber liner product and induces drag. In another implementation, a combination of cables, straps, or bands are linked together, thereby transitioning from one securing form to another (e.g., cables adjacent to straight (longitudinal) sides that are interconnected to bands adjacent to the curved radial ends).

The dual-cable system illustrated in FIG. 8 provides tension and downward pressure along an outer perimeter edge of the flexible liner 802. The same effect could also be accomplished using a single cable, but the dual-cable system may eliminate the need for tension application using special tools. Although FIG. 8 illustrates half of the pond system 800, it may be assumed that in at least one implementation, the cables 842, 844 attach on an opposite end (not shown) of the pond system 800 in the same or substantially the same manner as that illustrated.

The above specification, examples, and accompanying figures provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A pond system including:

a rigid sidewall enclosing a perimeter;

a single-piece drop-in flexible liner including:

a base portion surrounded by a sidewall portion, the sidewall portion configured to rest adjacent to an interior-facing surface of the rigid sidewall; and multiple tensioning tabs each having a fixed end attached to the base portion and a free end opposite the fixed end, each of the multiple tensioning tabs configured to extend under the rigid sidewall and radially outward from the base portion;

a means for securing the free end of each of the multiple tensioning tabs at a location external to the perimeter enclosed by the rigid sidewall.

2. The pond system of claim 1, wherein the means for securing the free end of each of the multiple tensioning tabs includes a means for securing each one of the multiple tensioning tabs against an exterior-facing surface of the rigid sidewall.

3. The pond system of claim 1, wherein the at least one securing mechanism attaches to an aperture on the free end of each one of the multiple tensioning tabs.

4. The pond system of claim 3, wherein the aperture includes a hemmed loop and the means for securing the free end of each of the multiple tensioning tabs includes an object configured to thread through the hemmed loop of at least one of the multiple tensioning tabs.

5. The pond system of claim 1, wherein the flexible liner further includes:

a baffle curtain portion attached to the base portion and extending along a length of the base portion, wherein an interface between the baffle curtain and the base portion of the flexible liner is liquid impermeable.

6. The pond system of claim 1, wherein the base portion of the flexible liner further includes a rectangular pocket that includes an opening facing away from a center of the flexible liner and configured to receive a portion of a paddle wheel structure.

7. The pond system of claim 6, wherein the opening is formed at a perimeter edge of the base portion.

8. The pond system of claim 1, wherein the sidewall portion includes two pre-formed curved walls separated from one another by two elongated planar walls.

9. A method of assembling a pond system comprising:

positioning a flexible single-piece liner relative to a rigid sidewall such that a base portion of the flexible single-piece liner rests within the rigid sidewall, a sidewall portion of the flexible liner extends up over the rigid sidewall, and a plurality of tensioning tabs of the flexible liner extend under the rigid sidewall and radially outward from the base portion, each of the plurality of tensioning tabs having a fixed end attached to the base portion and a free end opposite the fixed end;

tensioning each of the plurality of tensioning tabs; and securing the free end of each of the multiple tensioning tabs at a location external to a perimeter enclosed by the rigid sidewall.

10. The method of claim 9, wherein each of the multiple tensioning tabs has a first end attached to the base portion and a second opposite end including an aperture, and wherein tensioning each of the plurality of tensioning tabs further comprises threading a securement mechanism through the aperture of each of the plurality of tensioning tabs.

11. The method of claim 10, wherein the aperture is a hemmed loop and the securement mechanism includes a cable that extends radially around at least part of the perimeter enclosed by the rigid sidewall and through the hemmed loop of each of the multiple tensioning tabs.

12. The method of claim 9, wherein the flexible single-piece liner further includes:

a baffle curtain portion attached to the base portion and extending along a length of the base portion, wherein an interface between the baffle curtain and the base portion of the flexible single-piece liner is liquid impermeable.

13. The method of claim 9, wherein the base portion of the flexible liner further includes a pocket with an opening facing away from a center of the flexible liner, the pocket sized and shaped to receive and secure a portion of a paddle wheel structure.

14. The method of claim 13, wherein the opening of the pocket is formed at a perimeter edge of the base portion.

15. The method of claim 9, wherein the sidewall portion includes two pre-formed curved walls separated from one another by two elongated planar walls.

16. A flexible pond liner comprising:

a base portion and a sidewall portion that form a cavity when the sidewall portion is configured to be secured against a rigid supporting sidewall;

multiple tensioning tabs each with a fixed end attached to the base portion and a free end opposite the fixed end, each of the multiple tensioning tabs configured to extend under the rigid supporting sidewall and radially outward from the base portion;

a means for securing the free end of each of the multiple tensioning tabs up against an external surface of the rigid sidewall.

17. The flexible pond liner of claim 16, where the means for securing the free end of each of the multiple tensioning tabs includes an object configured to thread an aperture on the free end of each one of the multiple tensioning tabs.

18. The flexible pond liner of claim 17, wherein the flexible pond liner further includes:

a baffle curtain portion attached to the base portion that extends longitudinally along a length of the base portion.

19. The flexible pond liner of claim 17, wherein the base portion of the flexible pond liner further includes a pocket with an opening facing away from a center of the flexible liner, the pocket sized and shaped to receive a portion of a paddle wheel structure.

20. The flexible pond liner of claim 19, wherein the opening is formed at a perimeter edge of the base portion.

* * * * *